US005662186A

United States Patent [19]

Welch

[11] Patent Number: 5,662,186

[45] Date of Patent: Sep. 2, 1997

[54] POWER-DRIVEN SNOWBOARD

[76] Inventor: Mark C. Welch, 6317 Polk St., Hollywood, Fla. 33024

[21] Appl. No.: 663,510

[22] Filed: Jun. 13, 1996

Related U.S. Application Data

[63] Continuation-in-part of Ser. No. 498,166, Jul. 5, 1995, abandoned, which is a continuation-in-part of Ser. No. 169,063, Dec. 20, 1993, abandoned.

[51] Int. Cl.[6] ..... A63C 5/08

[52] U.S. Cl. ..... 180/181; 180/9.23

[58] Field of Search ..... 180/181, 180, 180/87.042, 14.2, 9.23

[56] References Cited

U.S. PATENT DOCUMENTS

| | | | |
|---|---|---|---|
| 3,853,192 | 12/1974 | Husted | 180/181 |
| 4,035,035 | 7/1977 | Husted | 180/181 |
| 4,984,648 | 1/1991 | Strzok | 180/181 |

FOREIGN PATENT DOCUMENTS

| | | | |
|---|---|---|---|
| 2688701 | 9/1993 | France | 180/181 |

*Primary Examiner*—RIchard M. Camby

*Attorney, Agent, or Firm*—Ruden, McClosky, Smith, Schuster & Russell, PA

[57] ABSTRACT

A power-driven snowboard includes forward and rear regions, with the forward region measuring approximately two-thirds of the length of the board. The rear region is bent downwardly relative to the forward region by an angle of approximately 6 degrees. A drive unit is removably attached at the rear region of the snowboard and it includes a drive unit mounting assembly, a plurality of rollers rotatably supported in the mounting assembly, a motor propelling the snowboard, and a drive belt supported on the rollers and drivingly connected to the motor. The drive drive belt has ridges formed thereon for engaging the snow or ice upon which the snowboard is driven, and a cutout formed in the snowboard, and through which the belt engages the snow or ice below the snowboard, is rearwardly open as seen horizontally behind the drive belt.

10 Claims, 10 Drawing Sheets

POWER-DRIVEN SNOWBOARD

CROSS-REFERENCE TO RELATED APPLICATION

This application is a continuation-in-part of my application Ser. No. 08/498,166, filed Jul. 5, 1995, now abandoned which is a continuation-in-part of Ser. No. 08/169,063, filed Dec. 20, 1993, now-abandoned.

BACKGROUND OF THE INVENTION

1. Field of the Invention

The invention relates to snow vehicles, and more particularly to snow boards powered by an internal combustion engine.

2. Description of the Related Art

A power-driven board of this general kind is described in U.S. Pat. No. 4,984,648 to Strzok. Strzok describes a more or less conventional planar sled board provided with a broad belt which is driven by an internal combustion engine. The drive unit is disposed inside a box which covers more than one half of the board. The foot supports are provided at the top of the drive unit box, namely at a forward and at a rearward edge thereof, respectively.

The rear of the drive unit of the Strzok board is enclosed. This leads to snow and ice plugging and substantially reduced drive efficiency. In order to prevent such plugging, it is necessary in that prior art board to lower the drive prongs of the drive unit, so as to allow proper snow ejection. The result, of course, is found in the fact that the board is largely supported on the drive unit prongs and board surfing is not properly ensured. Additionally, the track of the Strzok device is mechanically inserted in the side walls of the sleds.

A power-driven ski and a propulsion cleat therefor are described in U.S. Pat. Nos. 4,035,035 and 4,984,648 to Husted. Husted discloses an exposed drive chain and propulsion cleat located behind the operator. One or both skis can be power skis.

It would be desirable to provide a power-driven snowboard, which overcomes the above-mentioned disadvantages of the prior art devices and methods of this general type and which allows dependable, secure and fast movement on snow and ice, proper snow ejection and superior mechanical stability.

SUMMARY OF THE INVENTION

A power-driven snowboard including a front portion on which an operator is positioned and a rear portion inclined at an angle to the front portion and including a drive unit attached thereto. The rear drive portion is about one-third of the length of the snowboard and is inclined at an angle of approximately three to ten degrees. The drive unit includes a plurality of rollers or wheels mounted in the unit and enclosed therein and supporting a ridged drive belt for driving the snowboard across snow or ice. The drive unit includes a rear opening to eject snow and ice from the drive unit.

DESCRIPTION OF THE PREFERRED EMBODIMENTS

Figure 1:
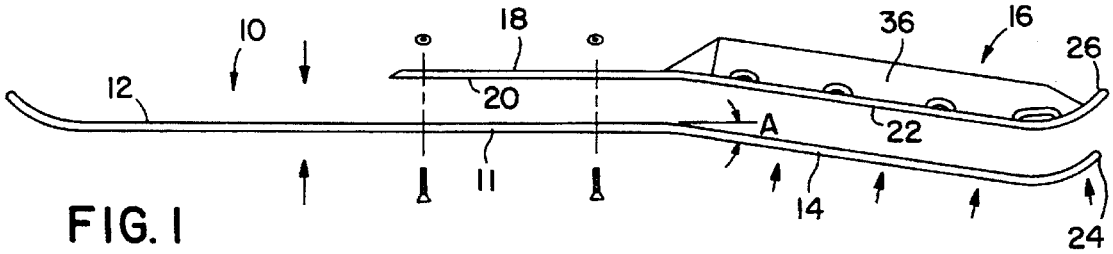
FIG. 1 is an exploded side elevational view of a snowboard and a drive unit mounting assembly of the present invention.
Figure 2:
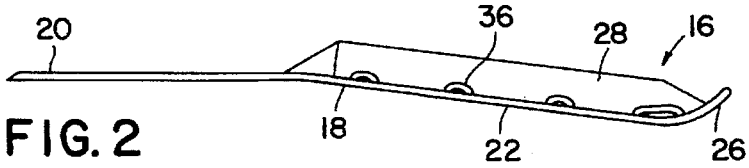
FIG. 2 is a side elevational view of the drive unit mounting assembly.
Figure 3:
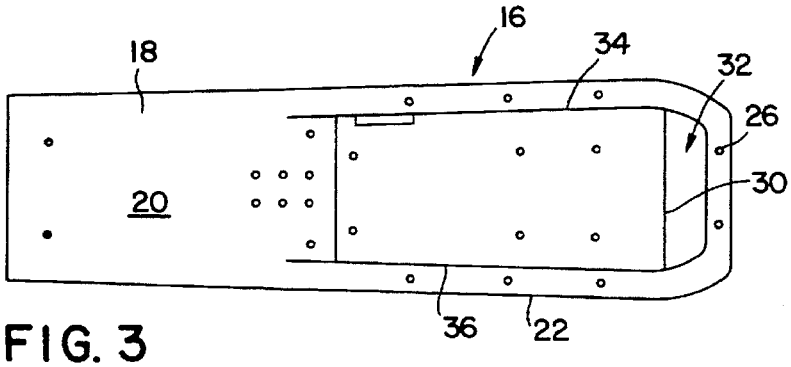
FIG. 3 is a top plan view thereof.
Figure 4:
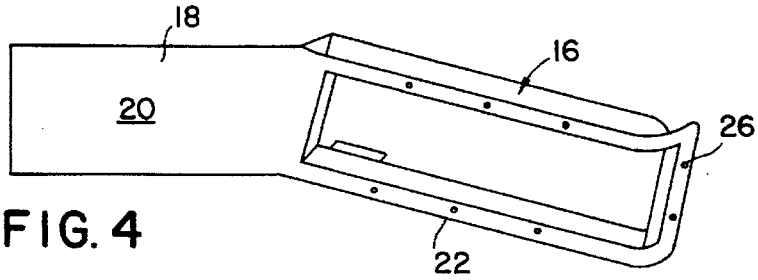
FIG. 4 is a bottom perspective view thereof.
Figure 7:
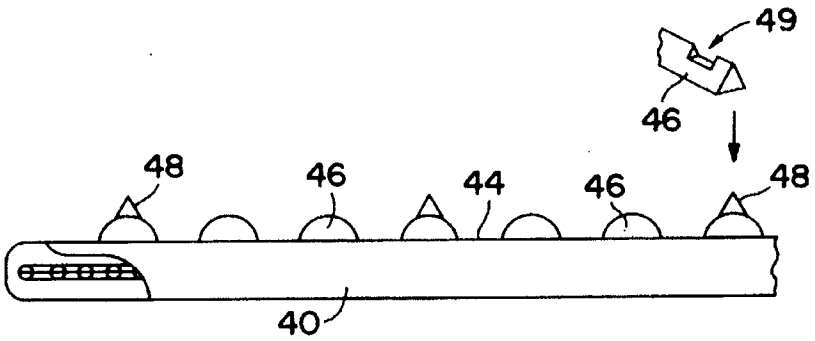
FIG. 7 is a fragmentary, side elevational view thereof.
Figure 5:
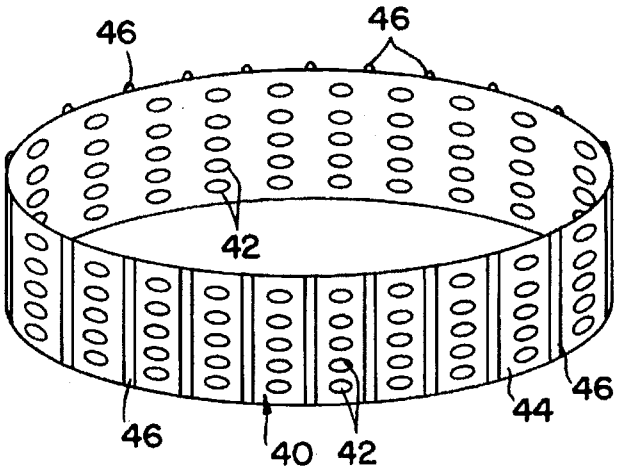
FIG. 5 is a perspective view of a drive belt according to the present invention.
Figure 8:
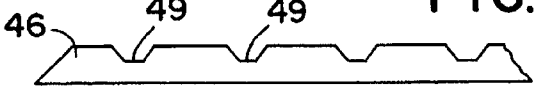
FIG. 8 is a side view of one of the ridges on the drive belt.
Figure 6:
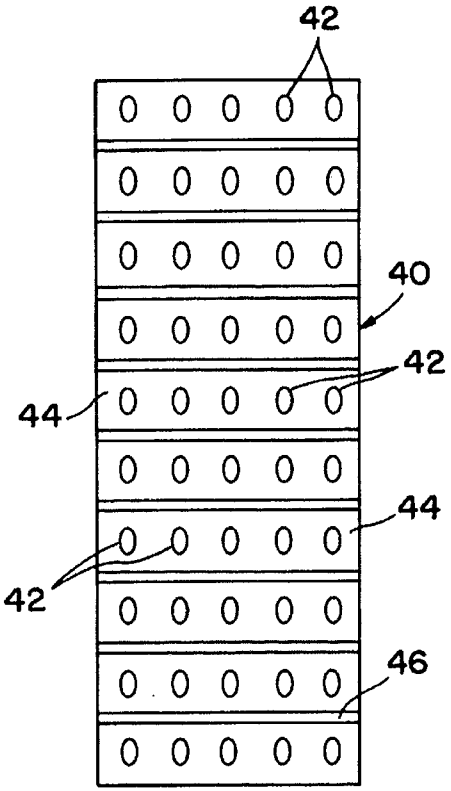
FIG. 6 is a plan view of the drive belt.
Figure 9:
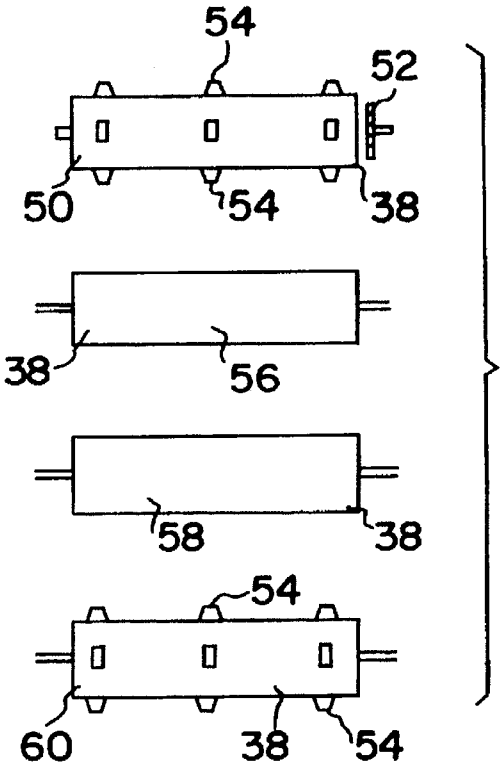
FIG. 9 is a top plan view of one four-roller drive assembly of the present invention.
Figure 12:
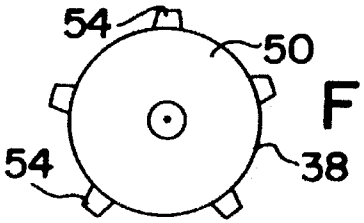
FIG. 12 is a side elevational view of the drive roller.
Figure 10:
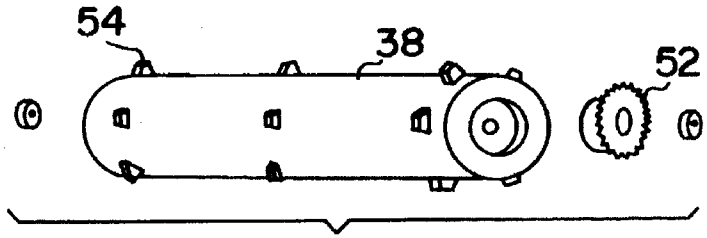
FIG. 10 is an exploded view of one forward drive roller.
Figure 11:
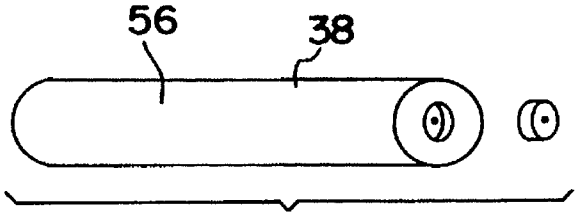
FIG. 11 is an exploded view of a central support roller.

Referring to FIG. 1, a first embodiment of a power-driven snowboard of the present invention is designated generally by the reference numeral 10. The snowboard 10 includes a base board 11 having a front portion 12 and a rear portion 14. The front portion 12 includes a pair of foot bindings (not illustrated), which an operator utilizes in a conventional manner. The rear portion 14 is inclined at an angle (A) of three (3) to ten (10) degrees to the front portion 12 and preferably about six (6) degrees.

Applicant has discovered that the combination of the angle (A) and forming the rear portion 14 to be about one-third the length of the snowboard 10 provides for an optimum performance of the snowboard 10. The weight distribution and the angle (A) combined with the drive unit described hereinafter provide the optimum engagement of the snowboard 10 with the snow or ice on which the snowboard 10 is operated.

The snowboard 10 is powered by a drive unit assembly 16, as illustrated in FIGS. 1–4. The drive unit 16 includes a base plate 18. The base plate 18 includes a front portion 20 and rear portion 22, which are angled and formed to mate with and be secured to the respective front portion 12 and rear portion 14. The drive unit 16 preferably is removably secured to the snowboard 10 by any conventional securing means, such as a plurality of bolts and nuts. The snowboard 10 also preferably includes an upwardly curved tail portion 24. The drive unit 16 also includes a mating curved portion 26. The drive unit 16 includes a raised cover portion 28, which encloses the drive belt and rollers (FIGS. 5–8). A rear wall 30 of the cover 28 is open and mates with an opening 32 formed in the rear portions 14 and 22. The opening 32 allows the drive unit 16 to eject snow and ice from the snowboard 10 to prevent jamming of the drive unit 16. The tail portions 24, 26 provide integrity to the snowboard 10 and are curved upwardly at an angle of about forty-five (45) degrees to facilitate the snow ejection.

The cover 28 also includes a pair of side walls 34, 36 onto which are mounted a plurality of drive rollers 38, as illustrated in FIGS. 9–12. The rollers 38 are engaged by an endless drive belt 40, as best illustrated in FIGS. 5–8.

The drive belt 40 includes a plurality of sets of openings 42, which are engaged by the rollers 38. An outer circumferential surface 44 of the drive belt 40 includes a plurality of ridges or blades 46 to drive the snowboard 10 across snow or ice. If desired for further traction some or all of the ridges 46 can include protrusions or knobs 48, either fixed or removable as described hereinafter. The ridges 46 can include notches 49. The notches 49 provide traction on packed snow or ice, while the knobs 48 provide better traction in deep snow. The ridges or blades 46 can be secured to the belt 40 with screws (not illustrated) inserted in the notches 49.

Referring now to FIGS. 9–12, the snowboard 10 preferably includes a plurality, such as four (4) of the rollers 38. A first roller 50 is a drive roller, driven by the motor through a gear wheel 52. The roller 50 drives the drive belt 40 by engaging the openings 42 with a plurality of gear teeth 54. The teeth 54 preferably are tapered or conically formed to ensure proper engagement in the openings 42.

A pair of intermediate rollers 56, 58 are utilized as idlers and support for the drive belt 40 and do not include gear teeth. A rear roller 60 again includes the gear teeth 54 to eject snow from the openings 42 and to maintain the alignment of the drive belts 40. The belt 40 can include the same number of openings 42 as the number of teeth 54, or can include more openings, as illustrated.

Figure 13:
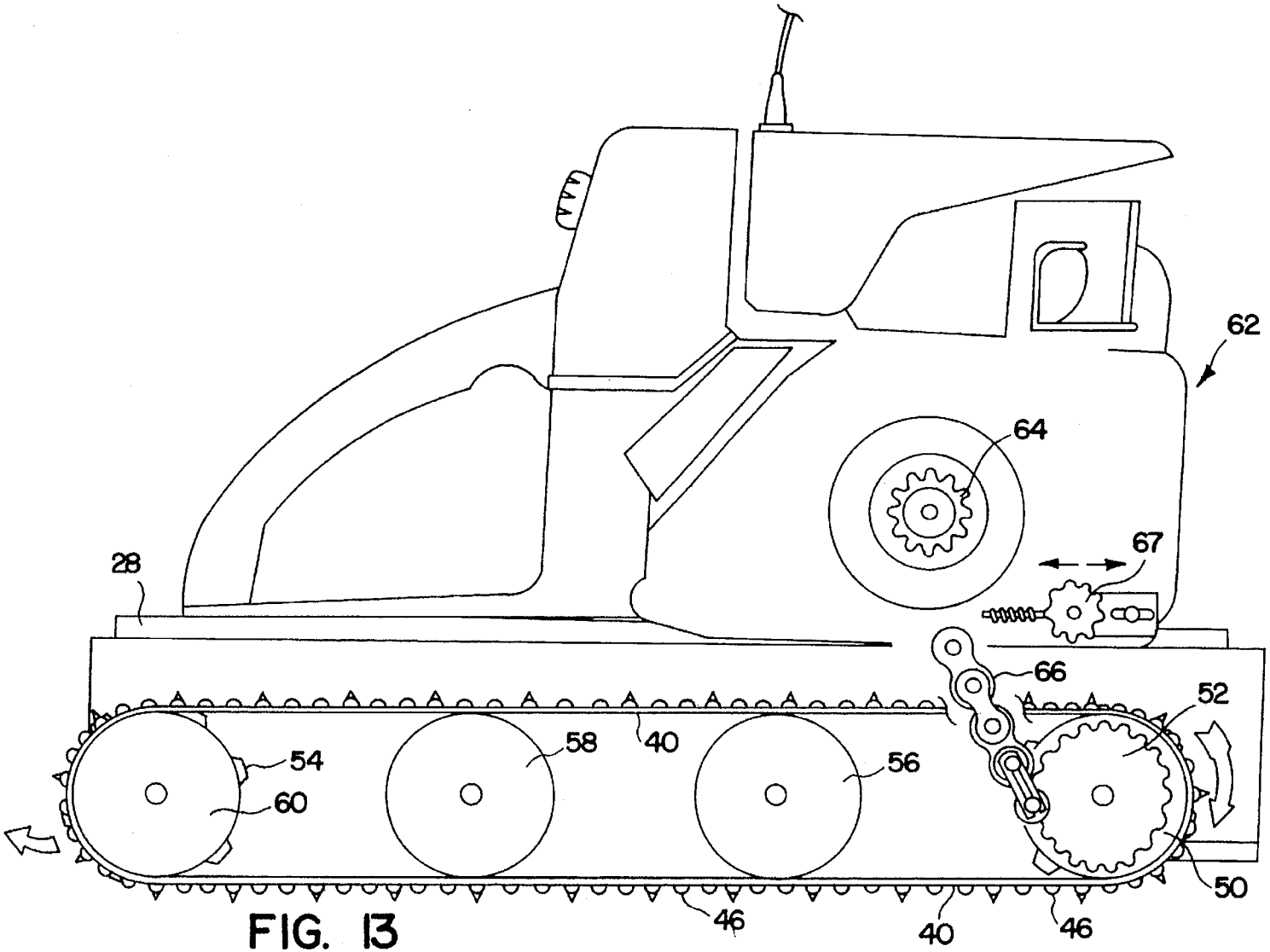
FIG. 13 is a side elevational view of an exemplary drive unit, including the motor, the drive chain, the rollers and the drive belt.
Figure 14:
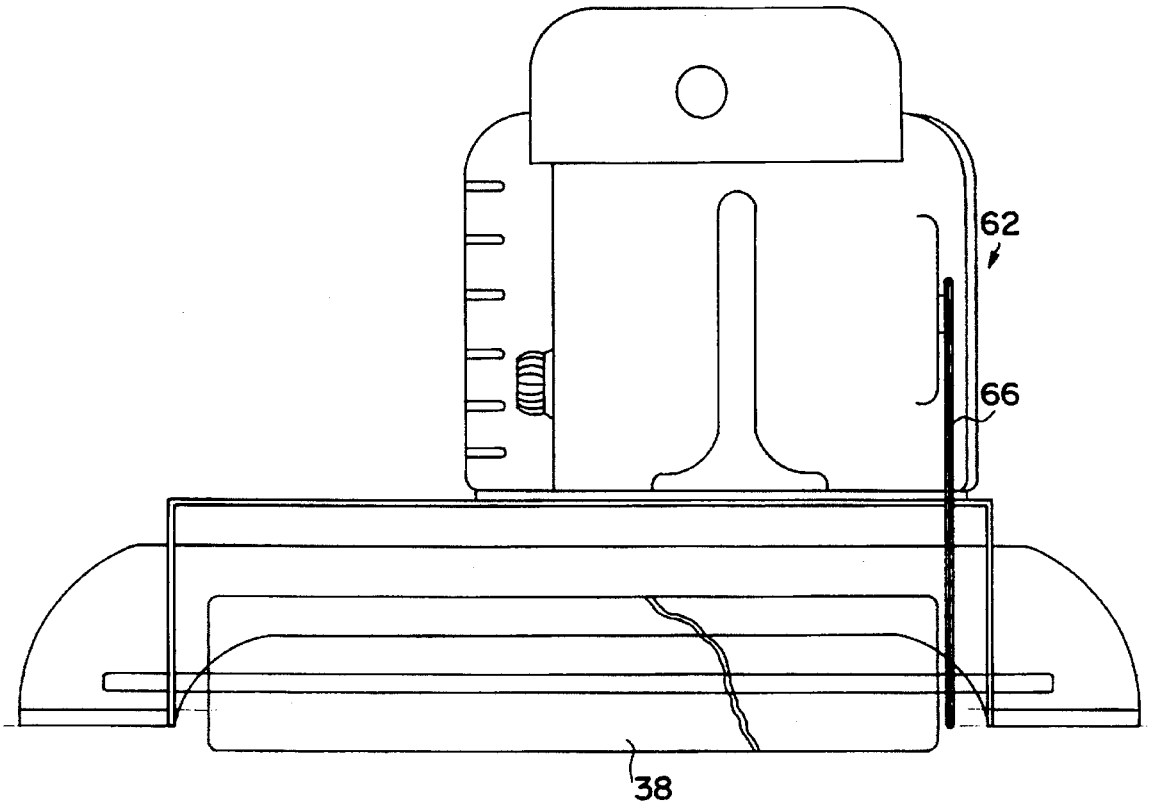
FIG. 14 is a rear elevational view thereof.
Figure 15:
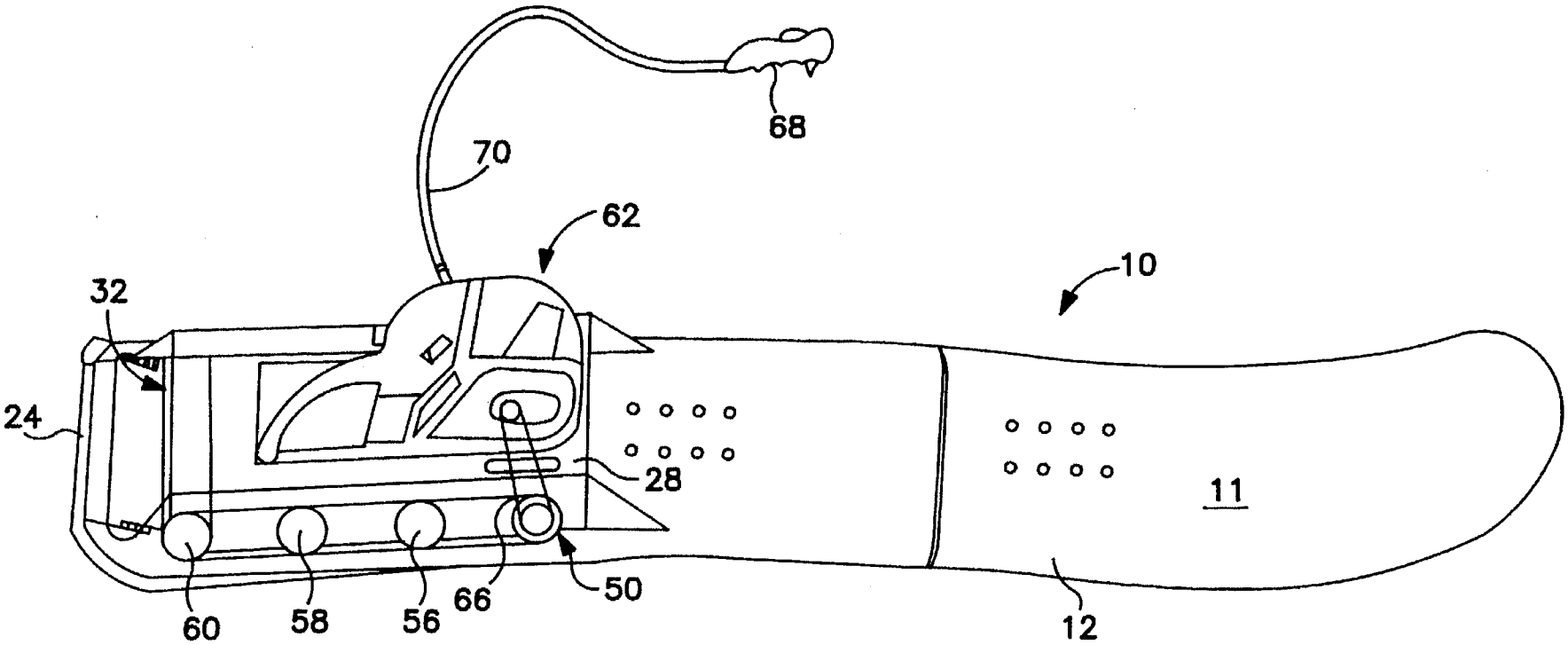
FIG. 15 is a perspective view of the power-driven board according to the invention.

The snowboard 10 can be driven by any type of internal combustion engine. In a preferred embodiment, as illustrated in FIGS. 13–15, the engine is a chain saw motor 62 mounted in the cover 28. The motor 62 includes a drive gear 64, which drives a chain 66, which in turn drives the gear wheel 52 of the drive roller 50. A tension sprocket 67 can be utilized to adjust the tension of the chain 66. To also aid in providing traction, the drive rollers 50 and 60 are mounted such that the rear roller 60 extends further from the base board 11 than the roller 50.

The assembled snowboard 10 is best illustrated in FIG. 15. In order to provide proper freedom of movement for the operator, the power controls are connected to a free-moving grip handle 68 through a flexible cable 70. The grip handle 68 carries a throttle lever and a kill switch. The switch is conventionally provided in order to stop the engine if the operator loses control.

Figure 16:
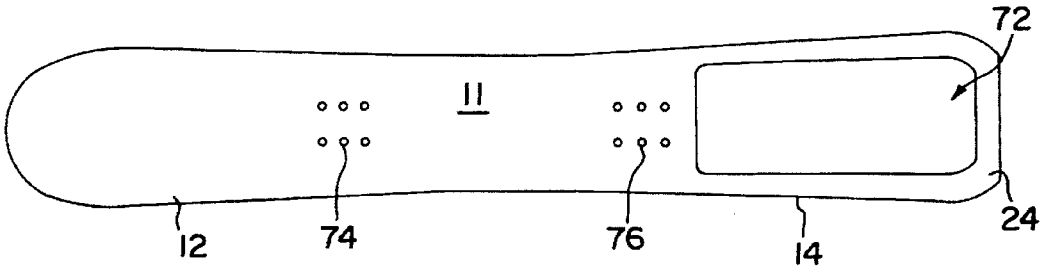
FIG. 16 is a top-plan view of the snowboard indicating the mounting locations for the foot bindings.
Figure 17:
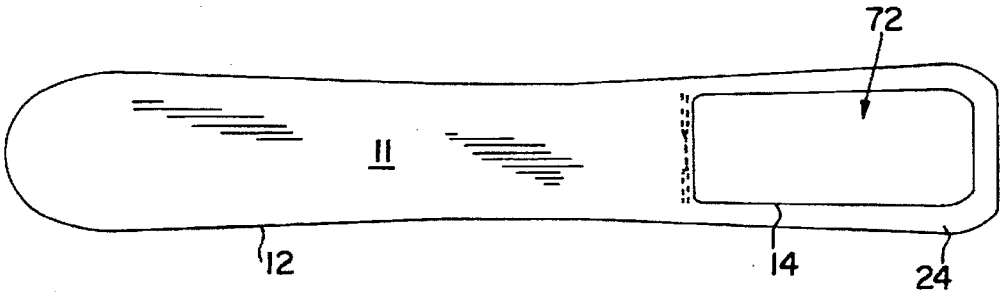
FIG. 17 is a bottom-plan view thereof.

Referring to FIGS. 16 and 17, the base board 11 is best illustrated. The rear portion 15 includes an opening 72 through which the drive belt 40 extends to drive the snowboard 10. Also, a pair of sets of apertures 74, 76 are provided in the top of the base board 11 for the operator foot bindings (not illustrated).

Figure 18B:
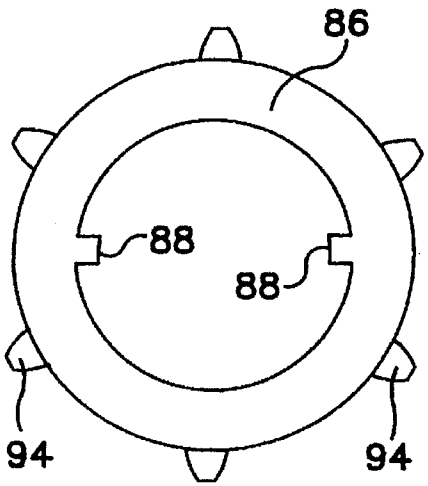
FIGS. 18A–18C are enclosed views of another drive roller embodiment of the present invention.
Figure 18C:
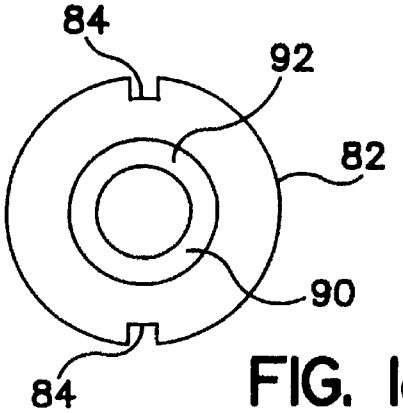
Figure 18A:
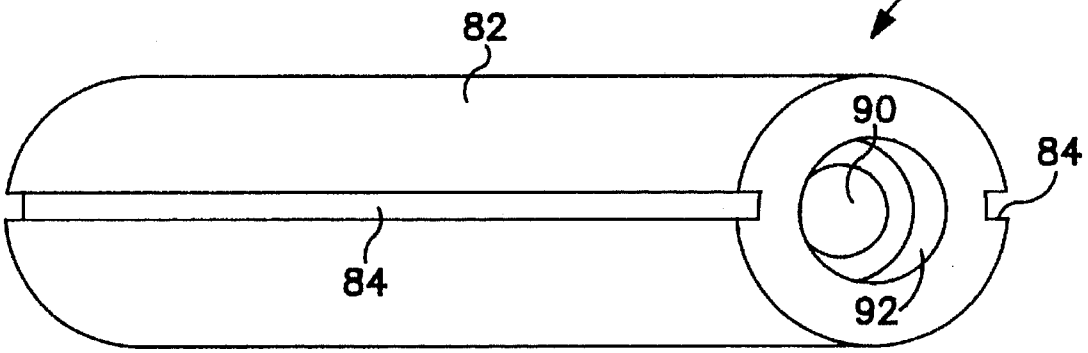
Figure 19A:
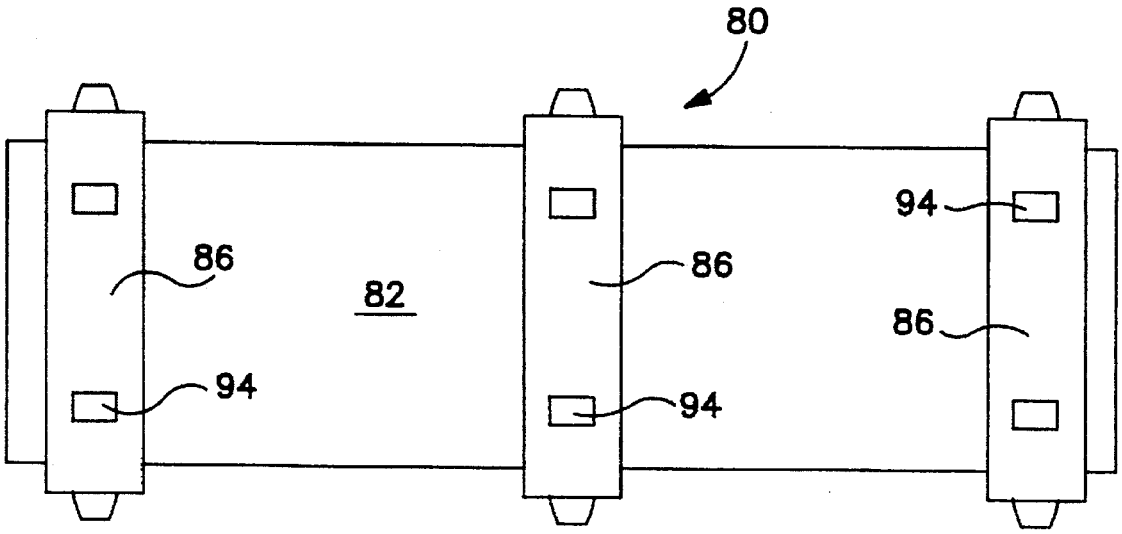
FIGS. 19A and 19B are views of the assembled roller of FIG. 18.
Figure 19B:
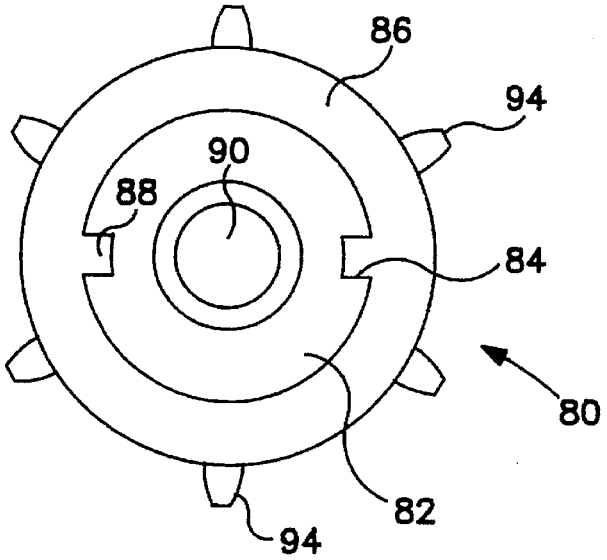
Figure 20A:
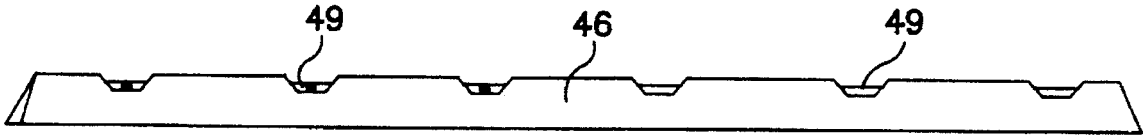
FIGS. 20A–20D are exploded views of a drive blade of the present invention.
Figure 20B:
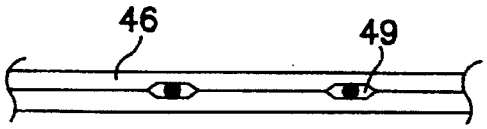
Figure 20C:
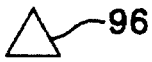
Figure 20D:
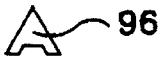

Although the roller 38 can be one piece molded rollers formed from any suitable cold and snow resistant polymer as illustrated in FIGS. 9–12, a multi-piece roller embodiment 80, is illustrated in FIGS. 18 and 19. The roller 80 includes a cylindrical body 82, which preferably includes one or a pair of grooves 84 along the length thereof. A drive gear or ring 86 is formed as a ring with one or a pair of tongues 88 which mate with the grooves 84 when the roller 80 is assembled as illustrated in FIG. 19. The body 82 includes a central passageway 90 through which an axle (not illustrated) is inserted for mounting the roller 80 in the drive unit 16. The body 82 also includes a recess for the gear wheel 52.

The roller 80 preferably includes three (3) rings 86 for driving the drive belt 40, as illustrated in FIG. 19. Each of the rings 86 is identical and has a plurality of gear teeth 94 aligned with one another by the grooves 84. The gear teeth 94 drive the drive belt 40 through engagement with the openings 42, as previously described.

Referring now to FIG; 20, the ridge On blade 46 is illustrated having the notches 79. For deep snow some or all of the notches can be provided with teeth 96. The teeth 96 can be screwed into the notches 49 when deep snow is going to be encountered.

The exemplary embodiment of the power-driven snowboard 10 according to the invention was assembled with the following commercially available parts: The belt 40 is a Jason Inc., 700H360, with slight modifications. The motor unit is a Stihl chain saw 035 with 4.6 horsepower. The gears are provided by Stock Drive Inc. and slightly modified. The main drive chain 66 also is provided by Stock Drive Inc. All bearings for the movable parts, most notably for the rollers 38, are from Florida Bearing Inc. The grip handle 68 is provided by Echo Inc. The board preferably is made of a composite system of wood, ABS plastic, fiberglass, and steel. The drive unit mounting assembly can be built from aluminum or optionally, a plastic and composite steel unit.

Many modifications and variations of the present invention are possible in light of the above teachings. The idler rollers also can be eliminated and replaced by wheels, similar to the rings 86, without the drive teeth 94. The wheels can be mounted directly on the axles without the body 82. The rings and/or the wheels provide further clearance for breaking up snow in the drive unit 16 and facilitating the ejection of the snow. The openings 42 in the drive belt 40, preferably are dimensioned to provide positive engagement with the gear teeth 54 or 94 and to eject snow and ice from the openings 42. The openings 42 can be about one-half (½) inch long by one-quarter (¼) inch wide. Also, the gear teeth 54 and 94 extend through the openings 42 for positive engagement with the drive belt 40, but preferably do not extend to the height of the ridges 46. The snowboard 10 thus preferably is driven across the snow or ice surface by the ridges 46 and not by the teeth 54 or 94. It is therefore, to be understood that within the scope of the appended claims, the invention may be practiced otherwise than a specifically described.

What is claimed is:

1. A power driven snowboard, comprising:

a substantially flat forward portion for sliding support on snow or ice and a rear portion for driving the snowboard;

said forward portion being an operator platform and forming about two-thirds of the snowboard and said rear portion connected to said forward portion at a downward angle of approximately 3–10 degrees;

a drive unit removably attached to the snowboard and having a drive belt supported by a plurality of rollers extending through an opening in said rear portion, said drive belt having a plurality of ridges for driving the snowboard across snow or ice; and said drive unit having a cover over said drive belt and rollers, said cover having a rearward opening for expelling snow or ice from said drive unit.

2. The snowboard as defined in claim 1, including said downward angle being about 6 degrees.

3. The snowboard as defined in claim 1 wherein said drive belt includes a plurality of openings and at least one of said rollers being a drive roller including a plurality of gear teeth for engaging with said drive belt openings.

4. The snowboard as defined in claim 3 including said drive roller located at a forward end of said drive unit and at least a rear roller also including gear teeth for maintaining said drive belt in alignment in said drive unit.

5. The snowboard as defined in claim 4 including at least one idle roller or wheel located between said drive roller and said rear roller to support said drive belt.

6. The snowboard as defined in claim 4 including at least one of said drive and rear rollers formed from a cylindrical body having a plurality of rings mounted thereon, said rings having said gear teeth formed therein.

7. The snowboard as defined in claim 3 including said gear teeth being tapered to ensure engagement in said drive belt openings.

8. The snowboard as defined in claim 1, including at least some of said ridges including a plurality of notches formed therein.

9. The snowboard as defined in claim 7 including at least some of said notches having teeth mounted therein.

10. The snowboard as defined in claim 1 including an upwardly curved tail portion.

* * * * *